US010793304B2

(12) United States Patent
Crawford et al.

(10) Patent No.: US 10,793,304 B2
(45) Date of Patent: Oct. 6, 2020

(54) HIGH-FLOW, LOW-VELOCITY GAS FLUSHING SYSTEM FOR REDUCING AND MONITORING OXYGEN CONTENT IN PACKAGED PRODUCE CONTAINERS

(75) Inventors: Jerry L. Crawford, Salinas, CA (US); Bob J. Dull, Akron, OH (US); Robert Tarango, Salinas, CA (US); Robert J. Schrader, Alameda, CA (US)

(73) Assignee: Dole Fresh Vegetables, Inc., Salinas, CA (US)

( * ) Notice: Subject to any disclaimer, the term of this patent is extended or adjusted under 35 U.S.C. 154(b) by 441 days.

(21) Appl. No.: 13/463,793

(22) Filed: May 3, 2012

(65) Prior Publication Data

US 2012/0279180 A1 Nov. 8, 2012

Related U.S. Application Data

(60) Provisional application No. 61/482,583, filed on May 4, 2011.

(51) Int. Cl.
*B65B 57/00* (2006.01)
*B65B 25/04* (2006.01)
(Continued)

(52) U.S. Cl.
CPC ..... *B65B 25/041* (2013.01); *B65B 9/20* (2013.01); *B65B 31/045* (2013.01); *B65B 31/06* (2013.01); *B65B 57/00* (2013.01)

(58) Field of Classification Search
CPC ..... B25C 1/06; B25C 1/00; B25D 11/066; B25D 11/068; B65B 31/04; B65B 31/041;
(Continued)

(56) References Cited

U.S. PATENT DOCUMENTS 2,025,331 A 12/1935 Bullurn
3,579,945 A * 5/1971 Buchner ..... B65B 31/045 53/511
(Continued)

FOREIGN PATENT DOCUMENTS

EP 1112936 A1 7/2001

OTHER PUBLICATIONS

International Search Report and Written Opinion received for PCT Patent Application No. PCT/US2012/036396, dated Jul. 16, 2012, 8 pages.
(Continued)

*Primary Examiner* — Chelsea E Stinson
(74) *Attorney, Agent, or Firm* — Polsinelli PC

(57) ABSTRACT

A system for reducing oxygen in a package of produce product using a lance manifold. The lance manifold has a first end adapted to receive an input gas flow and a second end adapted for placement in a partially-enclosed cavity containing the produce product. The second end of the lance manifold includes a plurality of exit ports adapted to produce an output gas flow and a sampling port for taking an air sample from the partially-enclosed cavity. The system also includes an oxygen analyzer for detecting oxygen content of gas inside the partially-enclosed cavity using the sampling port. The system is configured to produce an output gas flow with the following properties: a substantially oxygen-free composition; a flow rate of at least 100 standard cubic feet per hour (SCFH); and a flow direction substantially 90 degrees to a cavity opening of the partially-enclosed cavity.

20 Claims, 15 Drawing Sheets

(51) Int. Cl.
*B65B 31/06* (2006.01)
*B65B 9/20* (2012.01)
*B65B 31/04* (2006.01)

(58) Field of Classification Search
CPC ... B65B 31/042; B65B 31/044; B65B 31/045; B65B 31/01
USPC ..... 53/432, 433, 410, 411, 511
See application file for complete search history.

(56) References Cited

U.S. PATENT DOCUMENTS 3,664,086 A * 5/1972 James ..... B65B 9/20 141/4
3,789,888 A * 2/1974 James ..... B65B 9/213 141/4
3,939,624 A 2/1976 Gidewall et al.
3,968,629 A 7/1976 Gidewall et al.
4,084,390 A * 4/1978 Schmachtel ..... B65B 1/22 141/65
4,140,159 A 2/1979 Domke
4,241,558 A 12/1980 Gidewall et al.
4,377,618 A 3/1983 Ikeda et al.
4,409,252 A * 10/1983 Buschkens ..... B65B 31/043 426/316
4,548,020 A * 10/1985 Rozmus ..... B65B 1/48 141/198
4,566,249 A * 1/1986 Schwerdtel ..... B65B 3/32 53/511
4,658,566 A 4/1987 Sanfilippo
4,920,998 A * 5/1990 Deitrick ..... B23K 1/008 137/3
5,001,878 A 3/1991 Sanfilippo et al.
5,228,269 A 7/1993 Sanfilippo et al.
5,323,589 A * 6/1994 Linner ..... B29C 57/10 53/281
5,402,906 A 4/1995 Brown et al.
5,452,563 A 9/1995 Marano et al.
5,502,894 A 4/1996 Burke et al.
5,816,024 A 10/1998 Sanfilippo et al.
6,220,000 B1 * 4/2001 Kammler ..... B65B 1/16 53/508
6,231,905 B1 * 5/2001 DelDuca ..... B65B 31/06 426/118
6,619,018 B1 * 9/2003 Sasaki ..... B65B 31/045 53/511
6,691,747 B1 2/2004 Marcus et al.
6,735,928 B2 * 5/2004 Kondo ..... B65B 9/20 53/433
7,152,387 B2 * 12/2006 Taylor ..... B65B 31/045 493/302
7,198,206 B2 * 4/2007 Soria et al. ..... 239/532
7,412,811 B2 8/2008 Marcus et al.
7,690,404 B2 4/2010 Marcus et al.
2004/0084087 A1 * 5/2004 Sanfilippo et al. ..... 137/487.5
2004/0185152 A1 9/2004 Garwood
2005/0029151 A1 2/2005 Shepard
2006/0022068 A1 2/2006 Soria et al.
2006/0102736 A1 5/2006 Sanfilippo et al.
2006/0162290 A1 * 7/2006 Kakita ..... B65B 31/045 53/434
2006/0213153 A1 * 9/2006 Sanfilippo et al. ..... 53/511
2008/0149184 A1 6/2008 Sanfilippo et al.
2008/0289299 A1 11/2008 Mansson et al.

OTHER PUBLICATIONS

Extended European Search Report (includes Supplementary European Search Report and Search Opinion) received for European Patent Application No. 12779925.2, dated Oct. 2, 2014, 8 pages.
International Preliminary Report on Patentiability received for PCT Patent Application No. PCT/US2012/036396 dated Nov. 5, 2013, 6 pages.

* cited by examiner

Product-in-Seal (PIS) Trial with New Lance, Tube-in-Tube and Control Welded Lance

Classic Romaine-Soledad

| Type N2 System | SCFH | Avg % O2 | # PIS | # Tested | % PIS Leaker | | z test |
|---|---|---|---|---|---|---|---|
| New Lance | 373 | 4.07 | 122 | 6000 | 2.03% | a | -1.1846 |
| Tube-in-Tube | 320 | 3.92 | 141 | 6000 | 2.35% | a | |
| Welded Lance-Control | 580 | 4.18 | 123 | 6000 | 2.05% | a | 0.0646 |
| New Lance | | | 122 | 6000 | 2.03% | a | |

Classic Romaine-Bessemer City

| Type N2 System | SCFH | Avg % O2 | # PIS | # Tested | % PIS Leaker | *SD | ** z test |
|---|---|---|---|---|---|---|---|
| New Lance | 360 | 3.89 | 97 | 3036 | 3.19% | a | 0.0627 |
| Tube-in-Tube | 320 | 3.41 | 95 | 3000 | 3.17% | a | |
| Welded Lance-Control | 480 | 3.67 | 342 | 3018 | 11.33% | a | 12.2065 |
| New Lance | 360 | | 97 | 3036 | 3.19% | b | |

Classic Romaine-Springfield

| Type N2 System | SCFH | Avg % O2 | # PIS | # Tested | % PIS Leaker | | ** z test |
|---|---|---|---|---|---|---|---|
| New Lance | 447 | 3.79 | 386 | 6000 | 6.43% | a | 0.1118 |
| Tube-in-Tube | 420 | 3.86 | 383 | 6000 | 6.38% | a | |
| Welded Lance-Control | 580 | 3.84 | 525 | 6000 | 8.75% | a | 4.7907 |
| New Lance | 447 | | 386 | 6000 | 6.43% | b | |

* Number scores with different letters are considered significantly different at the 0.05 level.
**z Test Analysis with z <+/- 1.96 are not significantly different at 0.05 level
All trials were run at 45 psi N2 and 55 bags/min

Fig. 10

| Correlation Study: In-Line O2 Analyzer vs. Bag Values | | | | | | |
|---|---|---|---|---|---|---|
| Product | R-square | No. Tested | Average % O2 Analyzer | Average % Bag Value | % O2 Difference | % O2 Bag Range |
| Caesar | 0.82 | 476 | 3.06 | 2.91 | 0.15 | 2-4% |
| Classic Romaine | 0.95 | 75 | 4.04 | 4.02 | 0.20 | 3-5% |
| Italian | 0.80 | 25 | 3.60 | 4.11 | 0.51 | 3-5% |
| 2 lb Chop Romaine | 0.81 | 75 | 5.57 | 5.99 | 0.43 | 6-7% |
| 10 oz Lettuce Shred | 0.78 | 25 | 7.75 | 7.95 | 0.20 | 7-9% |
| Classic Iceberg | 0.62 | 75 | 8.03 | 8.23 | 0.20 | 7-9% |
| WM Caesar | 0.18 | 75 | 0.87 | 3.05 | 2.18 | 2-4% |

Fig. 11

HIGH-FLOW, LOW-VELOCITY GAS FLUSHING SYSTEM FOR REDUCING AND MONITORING OXYGEN CONTENT IN PACKAGED PRODUCE CONTAINERS

CROSS REFERENCE TO RELATED APPLICATIONS

This application claims the benefit under 35 USC 119(e) of prior U.S. Provisional Patent Application No. 61/482,583, filed May 4, 2011, the disclosure of which is hereby incorporated by reference in its entirety.

BACKGROUND

1. Field

This application relates generally to a system for reducing and monitoring the oxygen levels in packaged produce containers and, more specifically, to using a lance manifold to deliver a high-volume, low-velocity flow of substantially oxygen-free gas to a bag containing fresh produce.

2. Description of the Related Art

A protective container, such as a polypropylene bag, can used to preserve the quality of packaged produce product while it is being transported and stored before consumption. The container isolates fresh produce contents from environmental elements that can cause damage or premature spoilage and protects the produce from contaminants and physical contact by forming a physical barrier. The container may also help to preserve the produce by maintaining environmental conditions that are favorable to the produce. For example, a protective container may reduce oxygen consumption and moisture evaporation by trapping a pocket of air around the packaged produce.

One common protective container is the polypropylene bag, which forms a barrier that is both flexible and durable. A clear polypropylene bag also allows for the visual inspection of the product by the manufacturer, retail grocer, and end-user. Polypropylene bags can be produced at a relatively low-cost, and are compatible with numerous high-volume automated packaging techniques. For example, a vertical form, fill, and seal (VFFS) packaging process can be used to place fresh produce into polypropylene bags as they are formed. In a VFFS packaging process, a partially-enclosed cavity is created by folding or sealing the polypropylene film to form a pocket. The fresh produce is placed in the pocket and then sealed as the pocket is formed into a fully-enclosed polypropylene bag. In an alternative process, a polypropylene sleeve can be used to form an open-ended pocket. Fresh produce is placed in the pocket and the open end (or ends) are sealed using a sealing jaw. While these two examples are discussed in more detail below, various other techniques exist for packaging fresh produce.

As a typical result of these packaging processes, ambient air may be trapped in the sealed polypropylene bag. For some types of produce, the oxygen content of ambient air may affect the longevity or shelf life of the product. For example, if the produce includes fresh lettuce leaves, the oxygen content of ambient air (having oxygen content of approximately 21%) can cause a polyphenoloxidase reaction that degrades the quality of the lettuce leaves. Specifically, a polyphenoloxidase reaction causes pinking of the lettuce leaves, which is generally undesirable to the customer. However, as shown and discussed in the description below, the shelf-life of packaged lettuce leaf may be significantly extended if it is packaged in a protective container having initial oxygen levels between 1% and 9%. For example, see FIG. 7 which depicts significantly reduced pinking scores over time for Romaine lettuce that is packaged with an initial oxygen content of 3% and 1% as compared to packages having an initial oxygen content of 5%.

In some cases, air can be removed from a partially-enclosed polypropylene bag by applying a vacuum or by heat-shrinking the bag to conform to the dimensions of the produce. However, some fresh produce products, including lettuce leaf and other leafy vegetables, are too delicate to withstand either a vacuum sealing or heat-shrinking process. As a result, most packaging processes for leafy vegetables result in at least some volume of air trapped in the polypropylene bag. In fact, in some cases, a slight positive pressure of air inside the bag may even be desirable as it provides some mechanical cushioning for the produce product by slightly expanding the walls of the polypropylene bag away from the leafy vegetable contents.

Because the ambient air cannot be completely removed, the shelf life of the product may be extended by reducing the oxygen content of the trapped air. In some cases, the amount of oxygen contained in a polypropylene bag can be reduced by displacing some or all of the ambient air with an inert gas, such as nitrogen. There are existing devices that can be used to deliver a volume of nitrogen gas to the interior of a polypropylene bag before it is sealed. There are, however, several drawbacks to some existing systems. First, the exit velocity of the nitrogen gas may be too high, causing excessive turbulence in the bag. The turbulence can damage delicate produce product and may force the product out of the open end of the bag. Many existing systems also direct a majority of the flow toward the bottom of the bag, which can create a vortex-like flow also producing excessive turbulence.

The existing systems often use mechanical assemblies that are constructed using parts which are difficult to maintain and sanitize. One existing device delivers gas through concentric tubes positioned at or above the opening of a partially-formed bag (herein referred to as a tube-in-tube assembly). The tube-in-tube assembly is relatively heavy, is difficult to completely sanitize, and is costly to manufacture. The tube-in-tube assembly also directs nearly all of the flow toward the bottom of the bag.

It is desirable to reduce the amount of ambient oxygen trapped in a protective container to extend the shelf-life of the fresh produce without the drawbacks of existing systems.

SUMMARY

One exemplary embodiment includes a system for reducing oxygen in a package of produce product. The system comprises a partially-enclosed cavity for containing the produce product. The partially-enclosed cavity has a cavity opening. The system also includes a lance manifold having a first end and a second end. The first end of the lance manifold is adapted to receive an input gas flow. The second end of the lance manifold is adapted for placement in the partially-enclosed cavity. The second end of the lance manifold comprises: a plurality of exit ports adapted to produce an output gas flow and a sampling port for taking an air sample from the partially-enclosed cavity.

The output gas flow has the following properties: a substantially oxygen-free composition; a combined flow rate of at least 100 standard cubic feet per hour (SCFH); and a flow direction substantially 90 degrees to the cavity opening of the partially-enclosed cavity.

The system also includes an oxygen analyzer adapted to detect the oxygen content of gas inside the partially-enclosed cavity using the sampling port.

In some embodiments, the exit ports have a combined area of approximately 0.9 square inches. In some embodiments, the exit ports are further adapted produce an output gas flow having a maximum velocity of less than 100 feet per second (FPS) as measured at any one of the plurality of exit ports. In some embodiments, the lance manifold and plurality of exit ports are adapted to deliver the output gas flow at a pressure of less than 45 pounds per square inch (psi), as measured at any one of a plurality of exit ports.

In some embodiments, the plurality of exit ports are configured so that the exit port closest to the second end of the lance manifold is less than 3 inches from the bottom of the partially-enclosed cavity when the lance manifold is inserted. In some embodiments, the sampling port is disposed near the end of a sensor tube, the sensor tube extending from the second end of the lance manifold, wherein the sampling port is at least one inch from the closest exit port of the plurality of exit ports. The sensor tube may be at an angle of between 5 and 40 degrees from a primary axis of the lance manifold, the primary axis of the lance manifold being the axis that is substantially parallel to the direction of the gas flow while it is routed through the lance manifold.

In some embodiments, the lance manifold is constructed as a hollow tubular structure, the inside of the tubular structure adapted to route the input gas flow to the plurality of exit ports. In some embodiments, the tubular structure of the lance manifold has a cross-sectional area greater than 0.2 square inches. In some embodiments, the hollow tubular structure is constructed from a single piece of metal tubing.

DESCRIPTION OF THE FIGURES

FIG. 10 depicts measured oxygen concentration levels of the lance manifold as compared to two control systems.

FIG. 11 depicts a comparison between oxygen levels measured using the sensor port and oxygen levels measured using destructive testing techniques.

The figures depict one embodiment of the present invention for purposes of illustration only. One skilled in the art will readily recognize from the following discussion that alternative embodiments of the structures and methods illustrated herein can be employed without departing from the principles of the invention described herein.

DETAILED DESCRIPTION

The following description sets forth numerous specific configurations, parameters, and the like. It should be recognized, however, that such description is not intended as a limitation on the scope of the present invention, but is instead provided as a description of exemplary embodiments.

As mentioned above, a protective container can be used to protect fresh produce product while it is being transported from the packaging facility to a retail grocer and from the grocer to an end-user's kitchen. A protective container may also prolong the shelf-life of fresh produce product by isolating the contents from environmental factors that could cause damage or premature spoilage. In particular, the shelf-life of packaged produce including fresh lettuce can be extended if oxygen content is maintained between 1% and 9% initial concentration levels. An initial concentration level of oxygen represents the amount of oxygen contained in the air of the packaged produce immediately after being packaged. The oxygen content may change over time due to oxygen permeation of the package and/or due to oxygen consumption by respiring package contents.

To reduce the initial oxygen content, a flow of inert gas can be used to flush or displace the ambient air. The flow can be accomplished using a lance manifold or other device for delivering a volume of nitrogen to the inside of the polypropylene bag before it is sealed. The lance manifold device and flushing techniques described herein provide similar performance to existing systems, while reducing or eliminating some of the problems.

The lance manifold device and flushing techniques described below are capable of delivering a high flow of nitrogen gas at a low velocity using a device that is simple and relatively easy to sanitize. Because the lance manifold device allows for the gas to be delivered at a low velocity, turbulence in the bag is reduced. Too much turbulence can damage delicate leafy vegetables. Turbulence can also force lighter leaves toward the sealing jaw, causing sealing problems. Additionally, a lance manifold that delivers the nitrogen flow at approximately 90 degrees from the bag opening may further reduce turbulence and provide for more efficient displacement of ambient air while minimizing the amount of nitrogen gas that is blown out of the open end of the bag.

Figure 6:
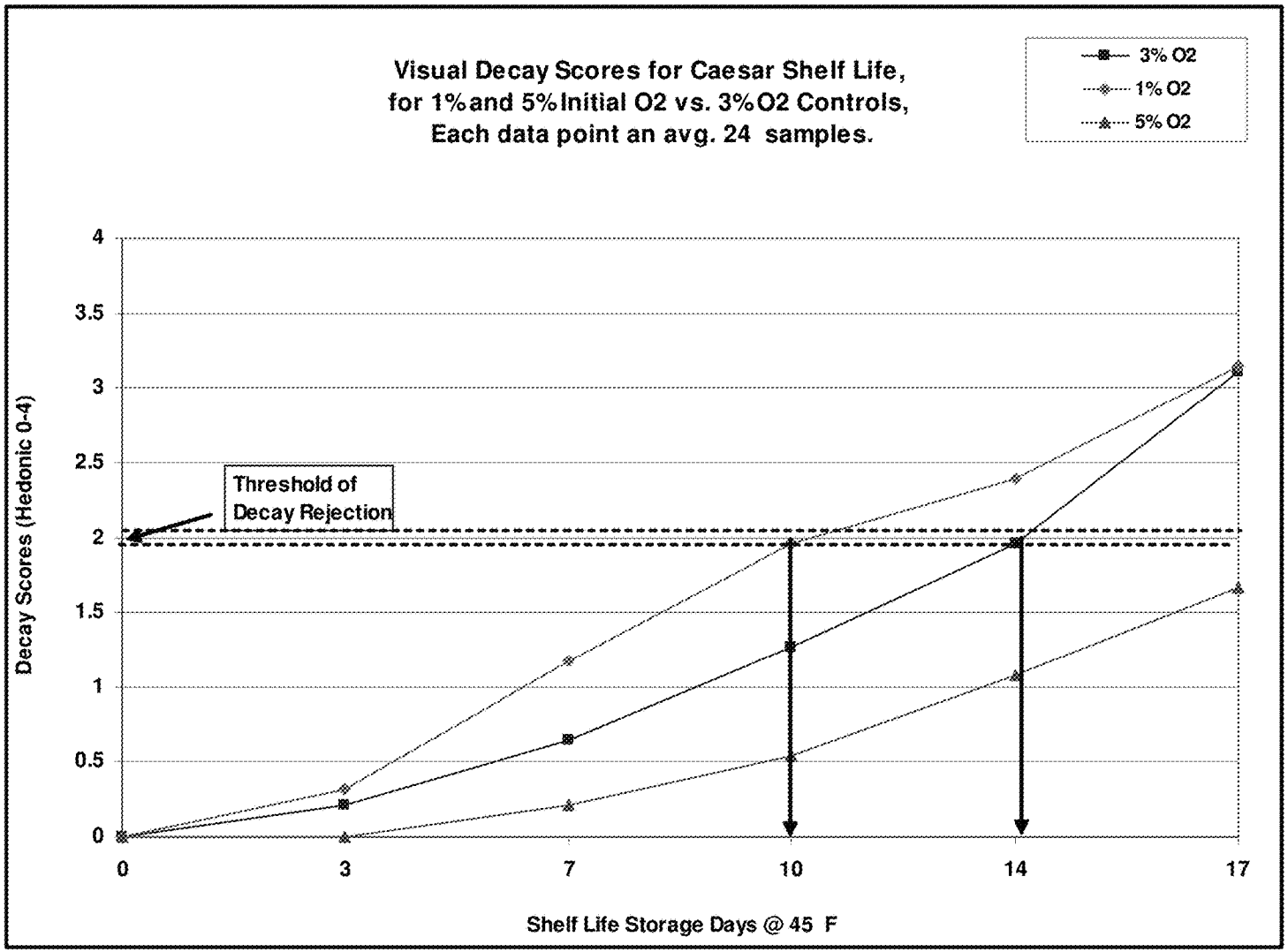
FIG. 6 depicts decay over time of romaine lettuce for packages having different amounts of oxygen.
Figure 7:
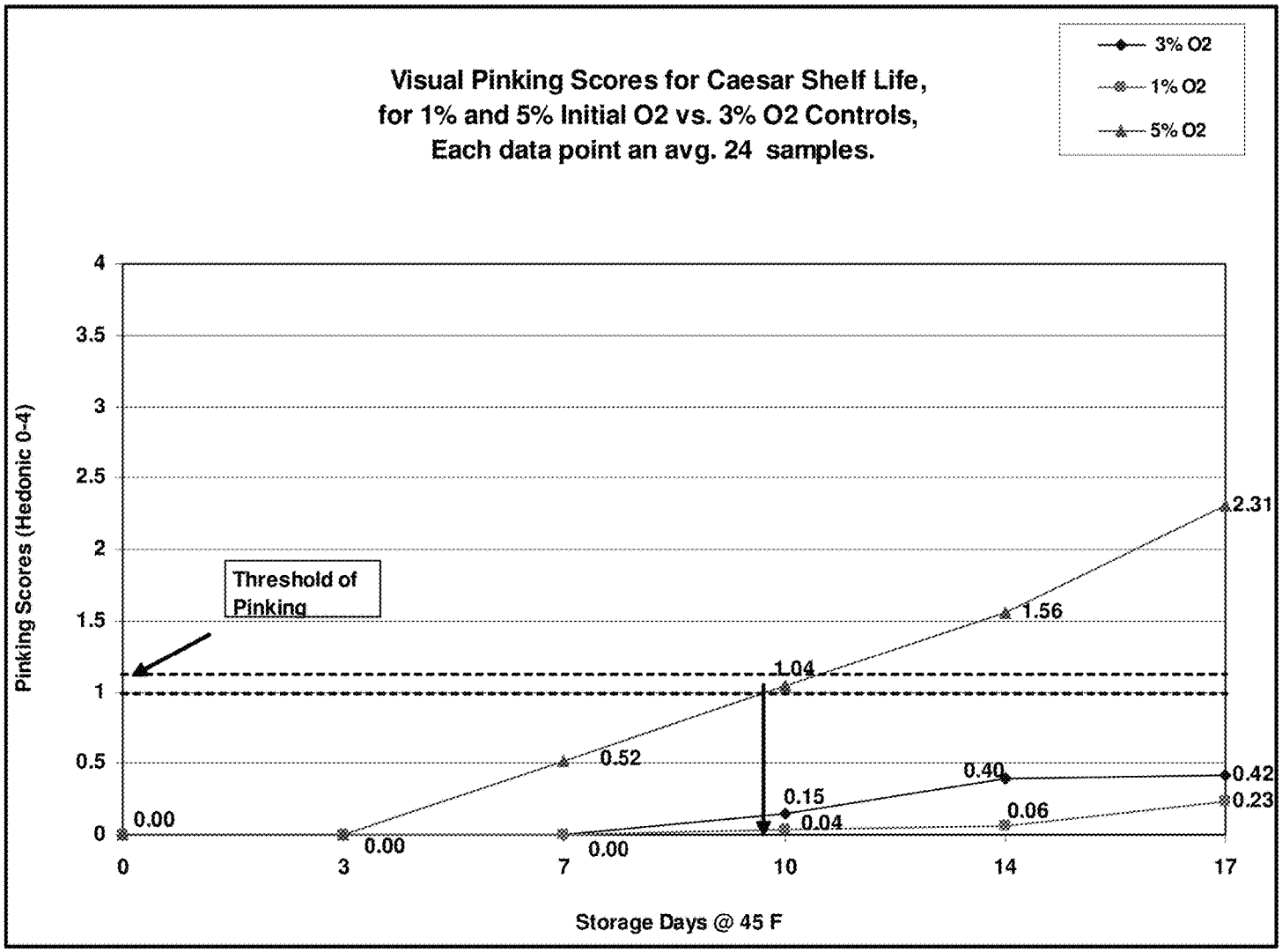
FIG. 7 depicts pinking over time of romaine lettuce for packages having different amounts of oxygen.

In some cases, it is beneficial to produce packaged produce having an initial oxygen content at or near a particular target value. For some packaged produce, such as Romaine lettuce, too much oxygen may cause a polyphenoloxidase reaction, which results in pinking of the lettuce leaves. FIG. 7 depicts a reduction in pinking scores over time for Romaine lettuce that was packaged with an initial oxygen content of 3% and 1% as compared to packages having an initial oxygen content of 5%. However, removing too much oxygen may result in premature decay of the lettuce leaves. As shown in FIG. 6, shelf-life may be reduced if the oxygen content is too low. For example, packaged produce with an oxygen content of 1% may decay one to four days faster than packaged produce with an oxygen content of approximately 5%. Therefore, it may be advantageous to continuously monitor and maintain a target oxygen concentration level.

Thus, in some embodiments, the lance manifold device also includes a sampling port allowing the oxygen content of the containers to be measured in real time. The sampling port is pneumatically connected to an oxygen analyzer that provides oxygen-level feedback to the system. The sampling port also allows the oxygen content of each package to be measured and recorded for quality assurance.

The measured oxygen levels can be used to provide real-time process feedback so that parameters of the nitrogen gas flow (e.g., flow rate, flow pressure) can be adjusted either manually or automatically. Alternatively or additionally, the oxygen levels can be used to change parameters of a packaging operation including, for example, packaging speed. The measured oxygen levels can also be used to track product quality over time. Previous techniques required destructive testing of a large sample of packaged product, costing time and wasting product.

In some embodiments, the lance manifold device described below is constructed using a single-piece manifold tube, which is relatively inexpensive to produce. The lance manifold can also be easily removed and disassembled from the forming tube assembly, which facilitates regular sanitation and maintenance operations.

1. Process for Displacing Oxygen in Packaged Produce Using a Lance Manifold

As mentioned above, one exemplary protective container is a polypropylene bag. Polypropylene bags can be produced at a relatively low cost, and are generally compatible with high-volume automated packaging techniques. For example, VFFS machinery can be used to form a polypropylene film into a pocket or partially-enclosed cavity in an automated fashion. A polypropylene film is fed into the machinery via a roll or sheet of material. The film is typically folded to form a partially-enclosed cavity into which fresh produce can be loaded. In some cases, the partially-enclosed cavity is sealed length-wise using a roll sealer to form a tube-shaped partially-enclosed cavity. Once loaded with fresh produce, the formed cavity can be sealed on one or both ends using a heat-sealing jaw to form a fully-enclosed polypropylene bag.

Alternatively, other bag-filling machinery can be used to fill partially-formed polypropylene bags with fresh produce in an automated or semi-automated fashion. For example, a polypropylene sleeve material can be used to create a partially-enclosed cavity by sealing the sleeve at one end. Produce product can be placed in the partially-enclosed cavity either manually or using automated machinery. The open end of the cavity can be sealed to form a fully-enclosed polypropylene bag.

Figure 1:
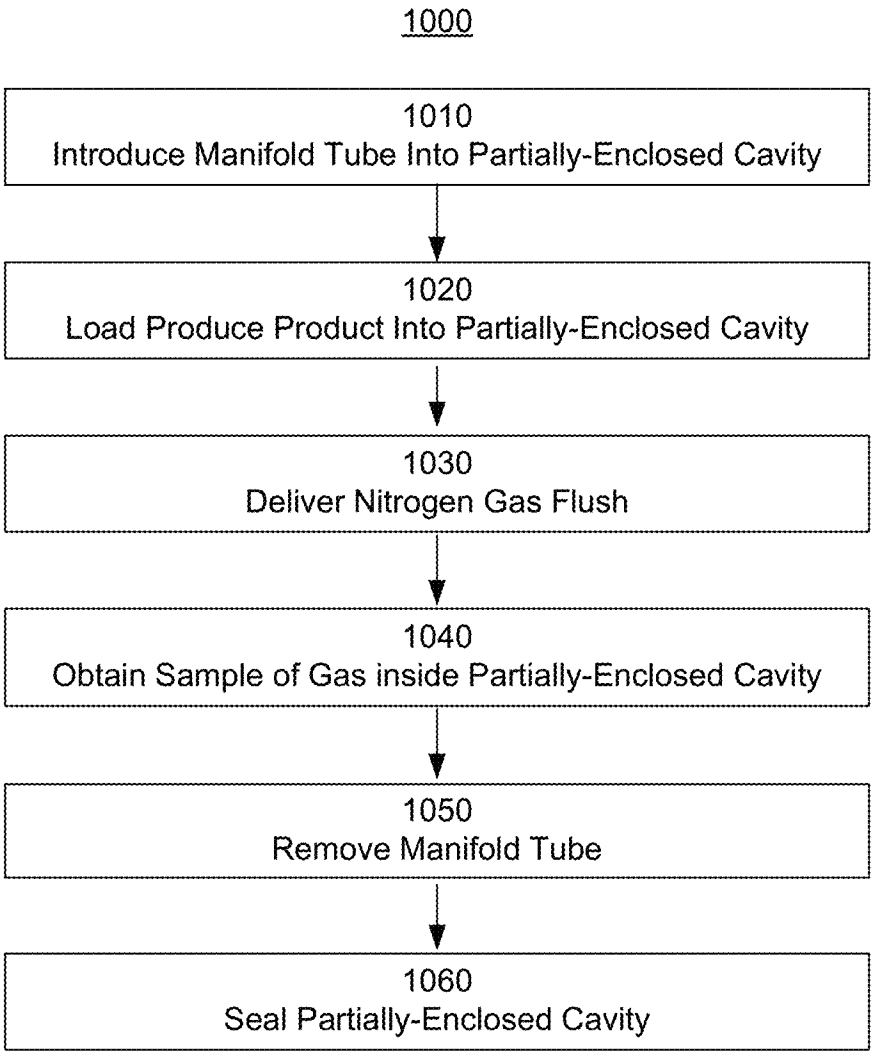
FIG. 1 depicts an exemplary process for reducing the amount of oxygen in packaged food containers.
Figure 2C:
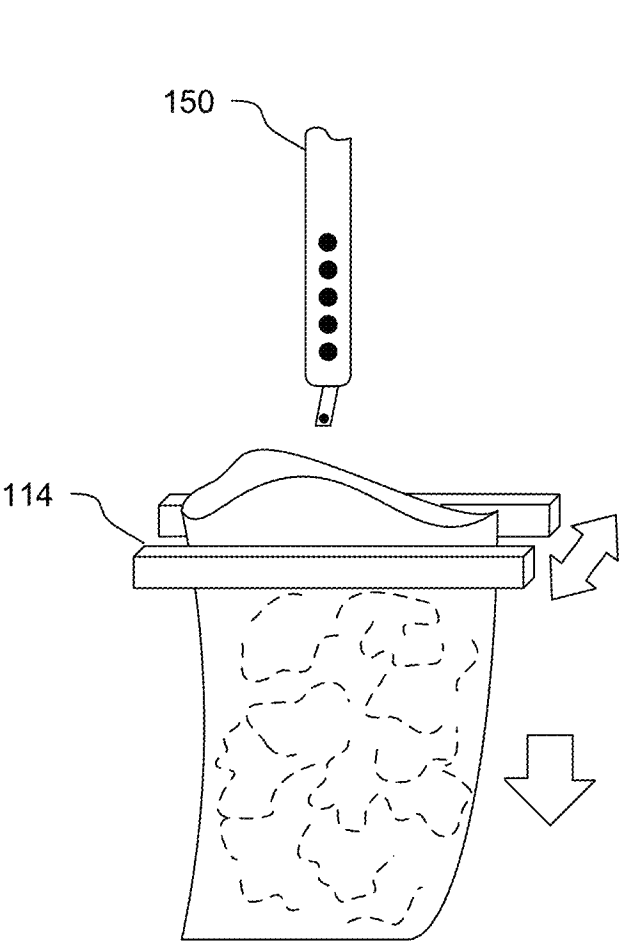
FIGS. 2*a*, 2*b*, and 2*c* depict components used in an exemplary process for reducing the amount of oxygen in packaged food containers.
Figure 2B:
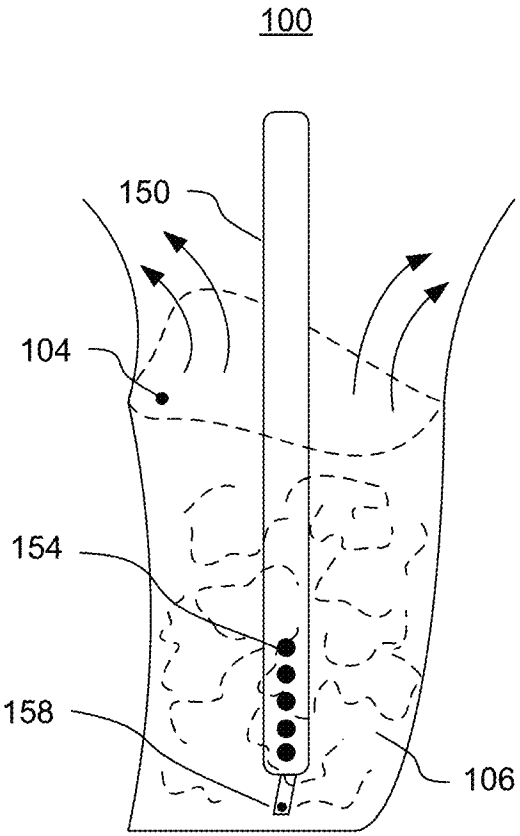
Figure 2A:
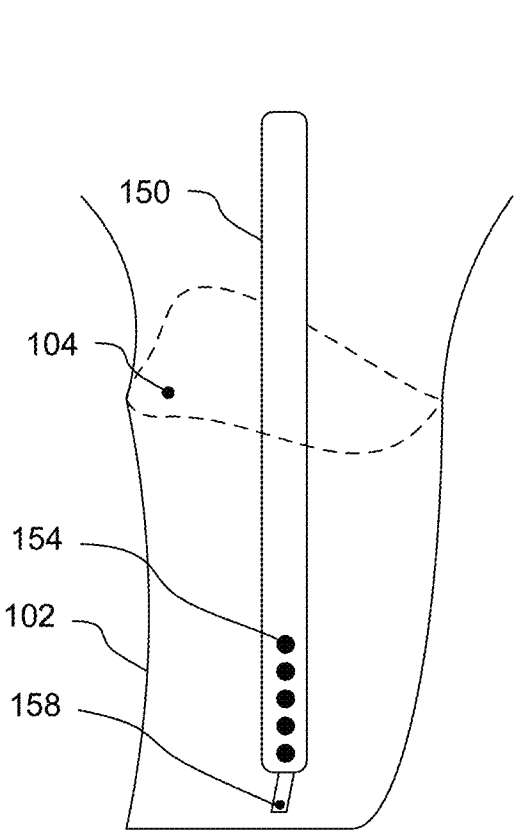

FIG. 1 depicts a flow chart of an exemplary process 1000 for reducing the amount of oxygen in packaged food containers. Process 1000 may be part of one of the automated or semi-automated packaging process described above. FIGS. 2*a*-2*c* depict components used in one embodiment of exemplary process 1000. For ease of explanation, the following example is given with respect to a process for packaging a leafy vegetable product (e.g., lettuce leaves) in a polypropylene bag. One of skill would recognize that these techniques can be applied to other types of fresh produce products and other types of food containers.

In operation 1010, the lance manifold is introduced into a partially-enclosed cavity. FIG. 2*a* depicts the components used in this operation. As shown in FIG. 2*a*, a lance manifold 150 is introduced to a partially-enclosed cavity 102. The partially-enclosed cavity 102 and lance manifold 150 are positioned so that exit ports 154 are located near the bottom of the partially-enclosed cavity 102.

In some cases, the partially-enclosed cavity 102 is placed or formed over a stationary lance manifold 150. For example, if the operation is implemented using VFFS packaging equipment, the partially-enclosed cavity 102 is formed around the lance manifold 150 and sealed at one end (the bottom end) using a heat-sealing jaw. In a typical VFFS packaging operation, the lance manifold 150 is stationary while the partially-enclosed cavity 102 is formed from a continuous sheet of packaging film. As shown in FIG. 2*a*, the partially-enclosed cavity 102 has a cavity opening 104 shown as a dotted line. The cavity opening 104 may be near the location where the top of the partially-enclosed cavity 102 is to be sealed using a heat-sealing jaw 114 as described below with respect to operation 1060 and FIG. 2*c*.

The mechanics of operation 1010 may vary depending on the packaging machinery being used to package the produce. For example, in some cases, the lance manifold 150 is attached to an actuating mechanism and is physically inserted into the partially-enclosed cavity 102. In this case, the lance manifold 150 is moved and partially-enclosed cavity 102 is stationary.

In operation 1020, produce is loaded into the partially-enclosed cavity. FIG. 2*b* depicts the components used in this operation. As shown in FIG. 2*b*, leafy vegetable produce 106 is loaded into the partially-enclosed cavity 102 around the lance manifold 150. If the packaging operation is performed in a vertical orientation (i.e., with the cavity opening 104 facing upward), the leafy vegetable produce 106 typically settles toward the bottom of the partially-enclosed cavity 102.

If the packaging operation is implemented using VFFS packaging equipment, the leafy vegetable produce 106 is dropped through a forming tube above the partially-enclosed cavity 102 and lance manifold 150. In other cases, the leafy vegetable produce 106 may be manually placed in the partially-enclosed cavity 102.

In operation 1030, nitrogen gas is delivered to the partially-enclosed cavity. As shown in FIG. 2*b*, partially-enclosed cavity 102 can be flushed with a flow of nitrogen gas delivered using multiple exit ports 154 of the lance manifold 150.

As discussed above, it is advantageous to deliver the nitrogen gas at a high flow rate so that the partially-enclosed cavity 102 is flushed rapidly. The nitrogen gas can be delivered at a flow rate as high as 900 standard cubic feet per hour (SCFH). Typically, the flow rate is between 120 and 600 SCFH. The flow rate is at least partially dependent on the speed of the packaging operation. If the packaging operation is implemented using VFFS packaging equipment, the flow rate will be dependent on the bag feed rate. Typically, if the bag feed rate is increased, the flow rate will also be increased. The flow rate may also depend on the type of produce being packaged. Packaging operations for produce that requires lower levels of oxygen in the package will typically operate at higher flow rates than operations for produce that can tolerate higher levels of oxygen.

It is also advantageous to deliver the nitrogen gas at a low exit velocity so that turbulence inside the partially-enclosed cavity 102 is minimized. A low exit velocity also reduces the risk of leafy vegetable produce 106 being blown out of the partially-enclosed cavity 102 or into the sealing jaws 114 of the packaging equipment. The lance manifold 150 and exit ports 154 are configured to deliver the nitrogen gas at a velocity and pressure sufficiently low to allow the leafy vegetable product 106 to settle in the bottom of the partially-enclosed cavity 102. The velocity and pressure are also sufficiently low to prevent excessive nitrogen leakage through the cavity opening 104. Typically, the average exit velocity is between approximately 5 and 50 feet per second (FPS).

In some cases, the flow of nitrogen gas is initiated after the lance manifold 150 is inserted in the partially-enclosed cavity 102. In other cases, the flow of nitrogen gas is continuously flowing from the lance manifold 150 as the lance is introduced to the partially-enclosed cavity 102 and the partially-enclosed cavity 102 is loaded with leafy vegetable product 106. For example, if the packaging operation is implemented using VFFS packaging equipment, the nitrogen gas may continuously delivered at a constant rate while the packaging operations are performed.

In operation 1040, an air sample is obtained from the partially-enclosed cavity. As shown in FIG. 2*b*, a sample port 158 located at the end of the lance manifold 150 samples gas from the interior of the partially-enclosed cavity 102. This sample of gas is fed to an external oxygen analyzer (see item 508 in system schematic of FIG. 5) which is capable of providing an estimation of the oxygen content in the partially-enclosed cavity 102. In some cases, positive pressure inside the partially-enclosed cavity 102 (FIG. 2*b*) drives the air sample into the sample port 158. In other cases, a vacuum or pump can be applied to draw the air sample through the sample port 158.

In many cases, the oxygen content is continuously monitored and oxygen estimates are stored at a regular, repeating time interval. If the oxygen content is continuously monitored, the system may record or identify the oxygen estimate during and at the end of the bagging cycle so that the air sample is representative of the quality of the air inside the package after sealing.

The oxygen estimates taken using the sample port 158 can be used as feedback to the packaging process. For example, if the oxygen estimates indicate an increased level of oxygen, the flow rate of the nitrogen gas can be increased. This results in more ambient oxygen being displaced from the partially-enclosed cavity 102, thereby reducing the overall oxygen content. Likewise, if the readings indicate an increased level of oxygen, the flush can be conducted for a longer period of time, which also displaces more ambient oxygen, reducing the overall oxygen content. If the packaging operation is implemented using VFFS packaging equipment, the bag feed rate can also be reduced to compensate for increased oxygen levels.

The feedback from the sample port 158 and oxygen analyzer can be implemented automatically using a programmable logic controller (PLC) or other computer processor with memory and input/output circuitry sufficient for automated control of the packaging equipment. (See, e.g., item 510 in FIG. 5.) The feedback can also be implemented manually by a package machine operator. In some cases, the feedback will be used to maintain measured oxygen content to values ranging between 2% and 4% with a target value of 3%. The specific range and target values vary depending on the produce product being packaged. Lettuce and salad mix products may have a target value as low as 1% and as high at 10%.

The estimated oxygen content can also be stored over time for quality assurance statistics. For example, an oxygen content estimate can be stored and associated with a corresponding package of leafy vegetable product. The oxygen content estimate may be an indication of the quality of the packaging process as well as the quality of the packaged produce. The stored oxygen estimates can be used to track retained shelf-life samples. The oxygen estimates may reduce or eliminate the need for destructive testing, which wastes packaged produce product.

The estimated oxygen content can also be used to provide system operational statistics. If the oxygen content is continuously monitored, the recorded values can be used to track the percentage of time that the packaging equipment is in operation. For example, when the production equipment is interrupted or stopped, the gas flow to the lance manifold may be stopped or significantly reduced. As a result, the oxygen content of the air around the lance manifold 150 (and sample port 158) will gradually rise to atmospheric conditions. The sample port 158 can be used to detect the rise in oxygen content, which is an indication that the packaging equipment has been interrupted or stopped. In this situation, the total time that the oxygen content is below a certain threshold may be representative of the total time the packaging equipment is in operation.

In operation 1050, the lance manifold is removed from the partially-enclosed cavity. As described above in operation 1010, the mechanics of this operation depend on the packaging machinery being used to package the produce. FIG. 2*c* depicts the components of this operation. In some cases, the partially-enclosed cavity 102 is removed from a stationary lance manifold 150. For example, if the packaging operation is implemented using VFFS packaging equipment, the partially-enclosed cavity 102 is indexed downward away from the lance manifold 150 until the cavity opening 104 of the partially-enclosed cavity 102 is positioned near a heat-sealing jaw 114. In other cases, the lance manifold 150 is attached to an actuating mechanism and is physically removed from the partially-enclosed cavity 102.

In operation 1060, the partially-enclosed cavity is sealed to create a protective container. As shown in FIG. 2*c*, the partially-enclosed cavity 102 may be placed so that the cavity opening 104 is at or near a heat-sealing jaw 114. The heat-sealing jaw 114 partially melts the package film material to create a seal. Other techniques, including adhesive bonding or mechanical fastening can also be used to seal the partially-enclosed cavity 102. In some cases, it may not be necessary to form a completely air-impermeable seal. As a result of operation 1060, a fully-enclosed bag of leafy vegetable 106 is produced having reduced oxygen content.

The operations described above are typically performed under normal operating conditions. There may be some variation in situations such as the startup or shutdown of an automated packaging system. If the packaging operation is implemented using VFFS packaging equipment, it may be beneficial to initiate flow from the lance manifold for a fixed amount of time before the packaging operation is started. When VFFS packaging equipment is stopped, the continuous nitrogen flow to the lance manifold is cut off with a solenoid valve. Over time, the oxygen levels in the partially-enclosed cavity will climb to the oxygen levels of the ambient air, which is typically over 20%. Due to the increased level of oxygen, the system should be primed to allow the oxygen levels to be reduced before normal packaging operations are continued. Specifically, before starting VFFS packaging equipment, nitrogen flow through the lance manifold should be resumed for three to five seconds. This provides an extra initial flush of nitrogen and allows initial oxygen levels to drop before the VFFS packaging equipment and produce product is introduced into the partially-enclosed cavity. After the initial flush, packaging operations can be resumed as described above with respect to process 1000.

2. Lance Manifold

Process 1000, described above, can be used to displace the ambient air in a protective container, such as a polypropylene bag. It is desirable that the system be capable of producing a high flow of nitrogen so that ambient air is displaced quickly, thus facilitating a high-speed automated packaging process. It is also desirable that the system deliver the high flow at a low pressure and low velocity to minimize turbulence inside the container. As described above, excessive turbulence may damage delicate produce (e.g., lettuce leaves). Excessive turbulence may also disrupt the produce and force product out of the container or into the sealing jaws, causing an equipment malfunction or defective seal. It is further desirable to deliver a low-pressure and low-velocity flow at a 90 degree angle so that the amount of nitrogen that escapes from the top of the bag is minimized. Flow that is delivered at a 90 degree angle is also less likely to impinge directly on the bottom of the bag and create turbulent vortices.

Figure 3:
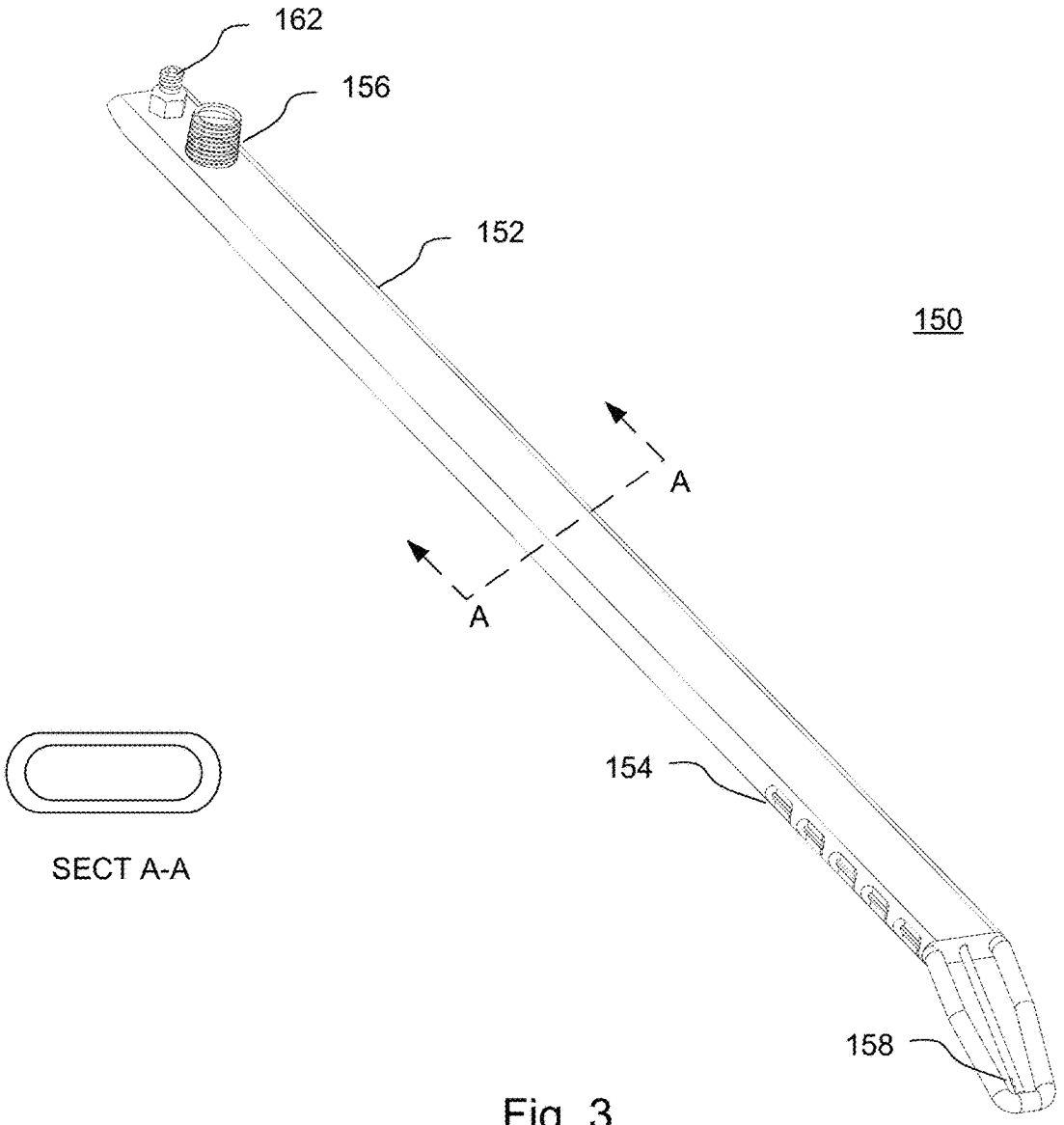
FIG. 3 depicts an exemplary lance manifold.
Figure 4:
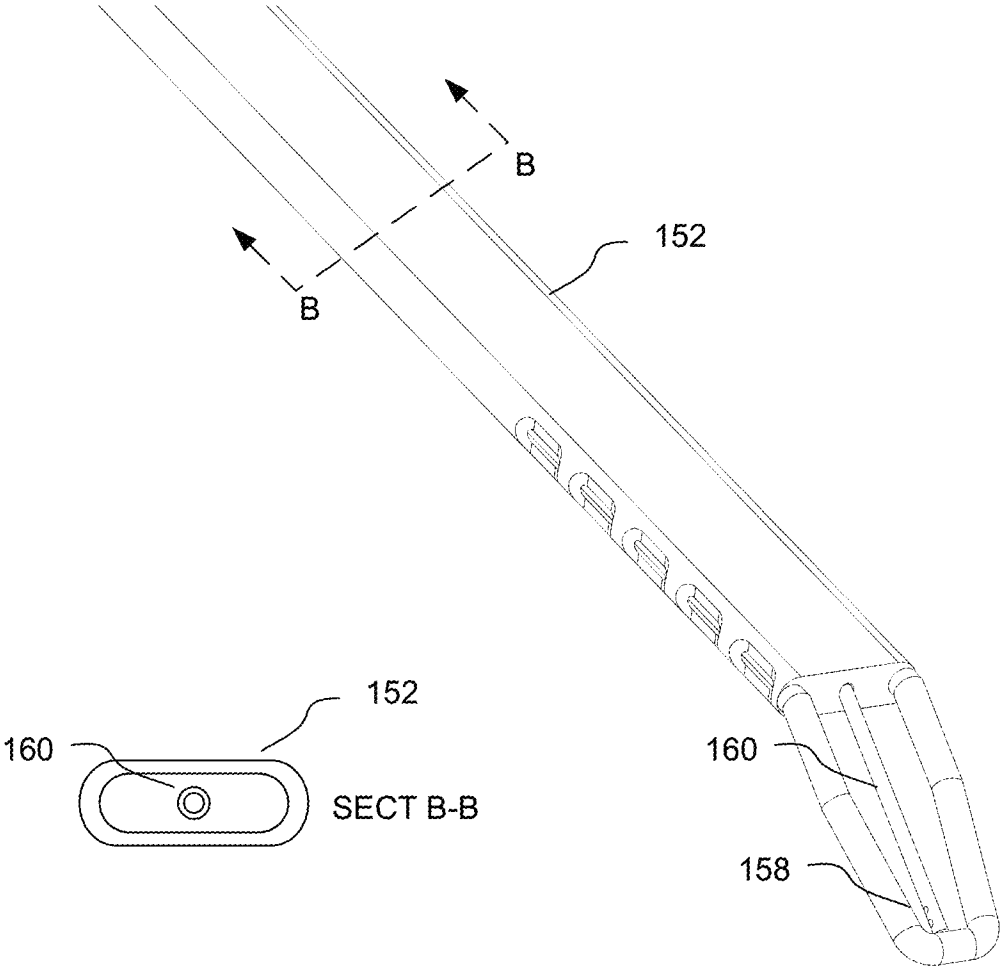
FIG. 4 depicts a sensor tube and sensor port on an exemplary lance manifold.

FIGS. 3 and 4 depict an exemplary lance manifold 150 that can be used to achieve these and other desired system characteristics by providing a high flow of nitrogen at a low pressure and low velocity at a 90 degree angle. The exemplary lance manifold 150 is also configured for deep insertion into a bag, which allows for rapid and efficient filling.

The exemplary lance manifold 150 depicted in FIG. 3 includes a single-piece manifold body 152. Manifold body 152 may be constructed using stainless tubing, which has been formed or extruded into a flattened profile shape. See, for example, the profile of the manifold body cross-section A-A in FIG. 3.

The size and shape of the manifold body 152 provide certain advantages when the lance manifold 150 is used to flush bags of fresh produce. For example, the manifold body 152 has an internal cross-sectional area that is sufficiently large to provide a high flow of nitrogen. The manifold body 152 depicted in FIG. 3 has approximately 0.2 square inches of internal cross-sectional area, and is capable of providing a flow rate as high as 900 SCFH. The flow rate may change depending on the size of the packaging container. Similarly, the specific internal cross-sectional area may also change depending on the application.

The length of the manifold body 152 is advantageous for delivering the flow of nitrogen deep into the bag. That is, the length of the manifold body 152 is sufficiently long to allow one end of the manifold body 152 to be placed close to the bottom of a partially-formed bag during the packaging process. The manifold body 152 depicted in FIG. 3 is approximately 22 inches long from the air input to the end of the manifold body that is placed into the bag. The lance manifold 150 depicted in FIG. 3 is designed for use in a VFFS packaging operation. In this example, the manifold body 152 is sufficiently long that the end of the manifold body 152 protrudes at least 2 inches from the forming tube of the VFFS packaging machinery. The length of the manifold body 152 may vary depending on the size of the bag and the specific packaging equipment used to fill the bag. In some cases, the length of the manifold body 152 is selected so that the end of the manifold body 152 is no more than 3 inches from the bottom of the bag, when inserted.

Other features of the manifold body 152 are also advantageous when packaging fresh produce. The flattened profile shape of manifold body 152 allows for a relatively large internal cross-sectional area while providing a relatively narrow insertion profile facilitating insertion in a flat polypropylene bag. The wall thickness of the manifold body 152 is approximately 1/16 inch, which is thick enough to provide structural integrity of the 22-inch-long manifold body 152 while maintaining a relatively large internal cross-sectional area.

Figure 8:
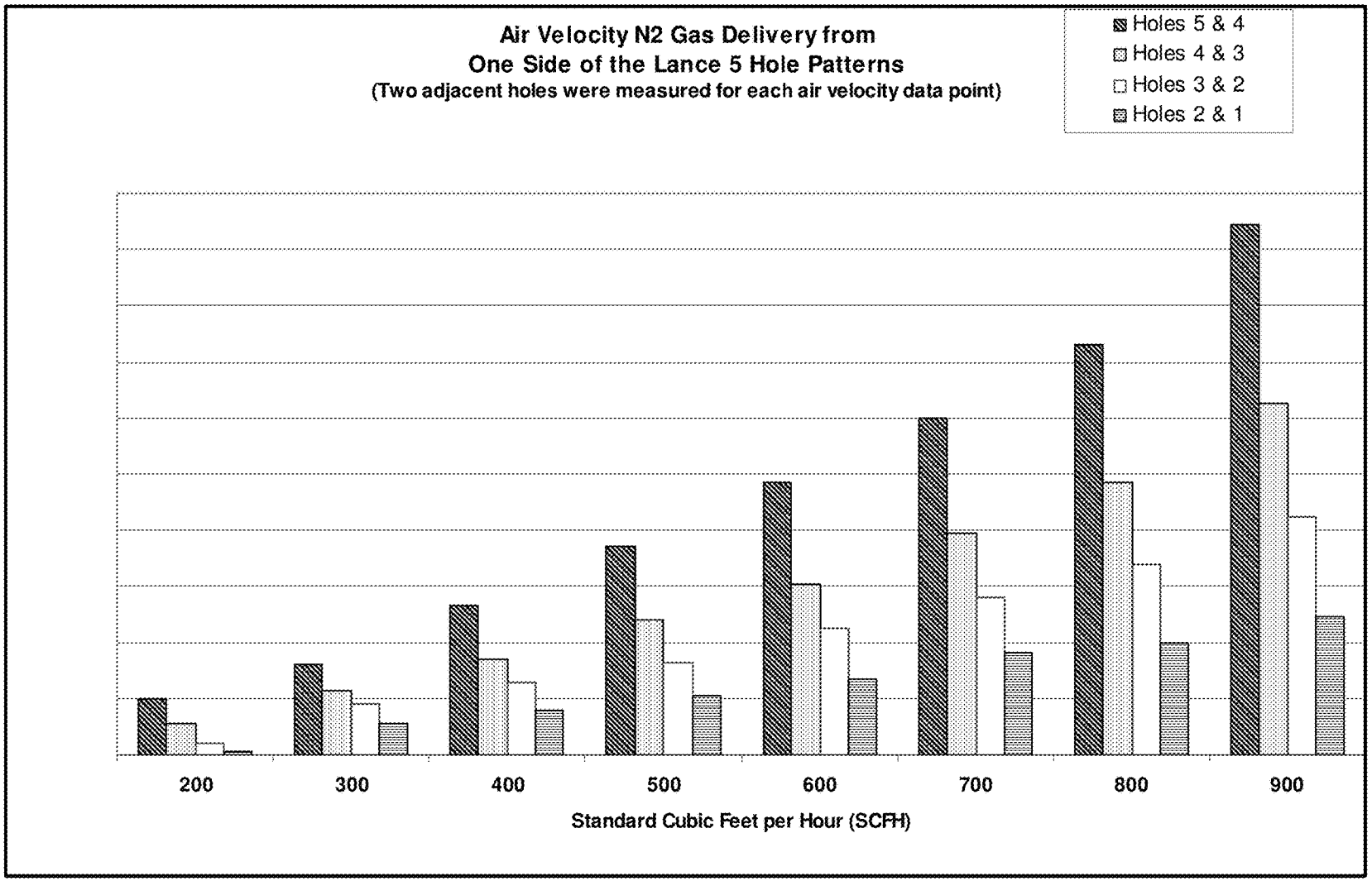
FIG. 8 depicts relative exit velocities for exit ports along the length of a lance manifold as a function of flow rate.
Figure 9:
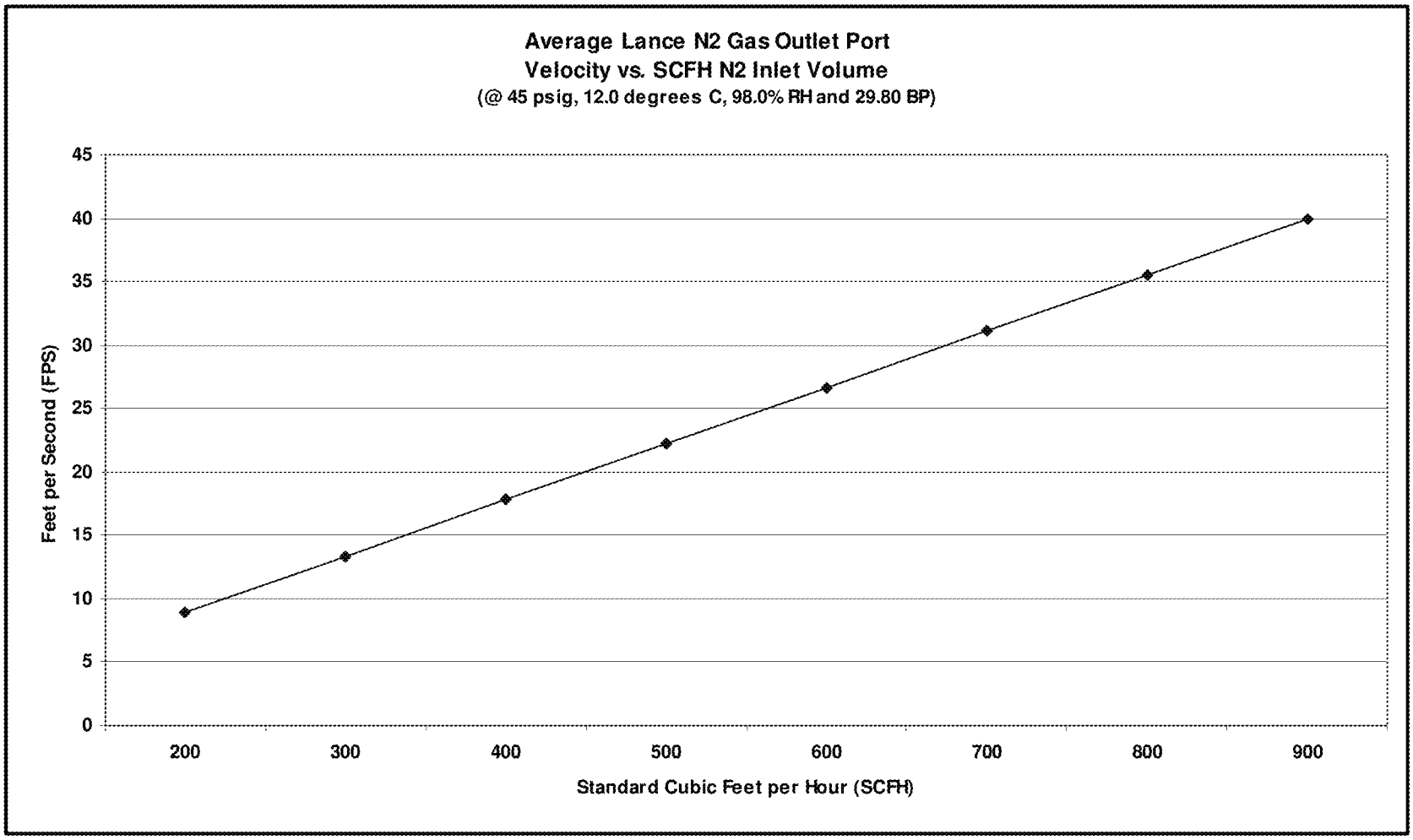
FIG. 9 depicts average exit velocities for a lance manifold as a function of flow rate.

The exemplary lance manifold 150 depicted in FIG. 3 includes ten exit ports 154, five on each side of the manifold body 152. The exit ports 154 are located toward the end of the manifold body 152 that is inserted into the bag. The location and size of the exit ports 154 are configured to deliver a high flow of nitrogen deep into the interior of the bag at a low velocity. In the lance manifold 150 depicted in FIG. 3, the combined area of the five exit ports 154 is approximately 0.9 square inches, which allows for relatively high flow of nitrogen at a relatively low exit velocity. FIG. 9 depicts estimated average exit velocities as a function of flow rate for an exemplary lance manifold similar to the embodiment shown in FIG. 3. Because the exit velocity is different for different exit ports 154 (see FIG. 8), the estimated average exit velocity shown in FIG. 9 does not represent the maximum exit velocity. Based on the estimated average exit velocities in FIG. 9 and the relative difference in exit velocities in FIG. 8, the maximum exit velocity for any one exit port 154 is estimated as less than 100 FPS.

The ten exit ports 154 are arranged along the length of the manifold body 152 so that the flow of nitrogen is gradually diffused into the bag. FIG. 8 depicts measured relative exit velocities for exit ports along the length as a function of flow rate for a lance manifold similar to the embodiment shown in FIG. 3. In FIG. 8, pairs of holes are numbered 1 through 5, with hole pair number 1 being furthest from the end of the manifold body that is inserted into the bag and hold pair number 5 being closest to the end of the manifold body that is inserted into the bag. As shown in FIG. 8, a large portion of the flow is delivered by the last two pairs of exit ports (hole pairs 5 and 4 in FIG. 8), which have the highest exit velocity. However, the flow of nitrogen is also delivered at exit ports along the length of the manifold body (e.g., hole pairs 1 through 3 in FIG. 8), which helps reduce the average exit velocity and reduces the peak exit pressure.

The velocity distribution shown in FIG. 8 is also advantageous in that it delivers a majority of the nitrogen flow deep into the bag. Because the exit ports direct the flow 90 degrees from the axis of the lance manifold, the nitrogen flow is delivered to the bottom of the bag without directing a large portion of the flow directly towards the bottom of the bag. This reduces potential turbulence due to vortices formed when flow is directed toward the bottom of the bag.

In other manifold configurations, there may be more than five exit ports or there may be fewer than five exit ports. The number and spacing of the exit ports may depend in part on the dimensions of the packaging container. For example, a deeper container may require more exit ports along the length of the manifold body 152. A deeper container may also require that the exit ports be spaced further apart. In addition, the combined surface area of the exit ports 154 may be increased for larger packaging containers requiring higher flow rates. In some embodiments, the combined surface area may exceed 5 square inches. Similarly, the combined surface area of the exit ports 154 may be decreased for smaller packaging containers requiring lower flow rates. In some embodiments, the combined surface area may be less than 1 square inch. As explained above, it is advantageous to provide exit ports with a relatively large surface area along the length of the manifold body 152 so that the flow of nitrogen is gradually diffused into the bag.

The exit ports 154, depicted in FIG. 3, are configured to direct an exit flow of nitrogen in a direction that is substantially perpendicular to the main axis of the manifold body 152. The exit flow direction is also perpendicular to the direction of insertion and/or opening of the container. An advantage of this configuration is that it reduces turbulence within the container. If the exit flow is directed toward the opening of the container, produce product may be blown out of the container or into the sealing jaw area. If the exit flow is directed toward the bottom end of the container, a vortex may be created which could also blow produce out of the bag or into the sealing jaw area. The 90 degree orientation of the flow is also an advantage for the efficient flushing of the container cavity. By blowing against the wall, the ambient air in the container cavity can be displaced without causing excessive leakage out of the open end of the container.

The exit ports 154 are also drilled or machined directly into lance manifold 150, which provides an advantageous construction. This construction provides a lance manifold 150 that is relatively easy to manufacture and easy to maintain because there are fewer parts to assemble. In particular, lance manifold 150 is designed to be removable so that it can be maintained and sanitized without interference from other components of the packaging machinery.

This construction is also amenable to sanitation and cleaning because there are fewer hidden surfaces or narrow openings. Lance manifold 150 is also amenable to adenosine triphosphate (ATP) testing, which sometimes requires that portions of the lance manifold 150 be swabbed for samples. In particular, exit ports 154 of lance manifold 150 have a large enough opening to allow for swabbing the lance manifold 150 to verify that a sanitation process was effective. The exit ports 154 on manifold 150 each have an opening of approximately 0.1 square inch.

The exemplary lance manifold 150 depicted in FIG. 3 includes an input port 156 for receiving an input flow of nitrogen gas. In this example, the input port 156 is constructed using a pneumatic fitting threaded into a wall of the manifold body 152. In some cases, the internal area of the input port 156 is equal to or smaller than the internal cross-sectional area of manifold body 152.

FIGS. 3 and 4 both depict sensor ports 158 used to sample the air from the interior of the container. The sensor ports 158 are pneumatically isolated from the interior of the manifold body 152 used to provide the flow of nitrogen. As shown in FIG. 4, air from the sensor ports is isolated from the flow of nitrogen by sensor tube 160, which runs down the center of the manifold body 152 to an output port 162. Cross-section B-B depicts an exemplary coaxial alignment of sensor tube 160 and manifold body 152.

As shown in FIGS. 3 and 4, the sensor ports 158 are located near the end of sensor tube 160, which extends from the end of the manifold body 152. The extension of the sensor tube 160 from the manifold body 152 allows for a more accurate sensor reading by locating the sensor ports 158 away from nitrogen flow produced by the exit ports 154.

The extension of the sensor tube 160 also facilitates air samples drawn from the bottom of the bag, where the gas in the bag is more likely to be mixed and oxygen content is more likely to be representative of the oxygen content of the initially-sealed bag. The lance manifold 150, shown in FIGS. 3 and 4, has a sensor tube 160 which is bent at an angle between 0 and 30 degrees. This facilitates deeper insertion into the bag without interfering with guides or sealing equipment (e.g., a stager assembly on VFFS packaging machinery).

The lance manifold 150 shown in FIGS. 3 and 4 also has multiple (four) sensor ports 158 located at the end of sensor tube 160. The multiple sensor tubes allow sensor readings to be performed even when there is partial or complete blockage of one of the sensor ports 158. The lowest sensor ports 158 also allow proper draining during and after sanitation processes.

3. System Schematic for Reducing Oxygen Levels in Bagged Produce

Figure 5:
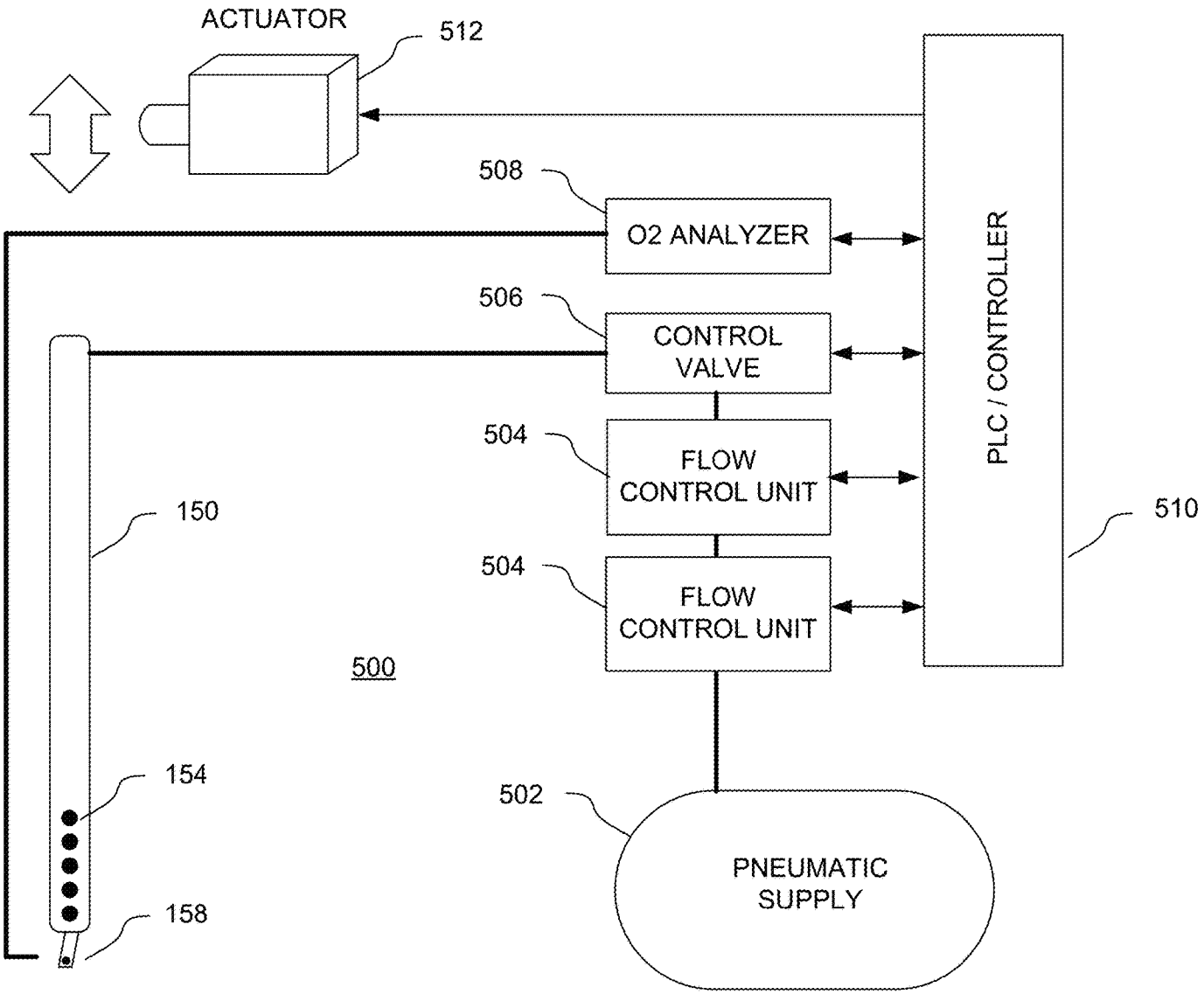
FIG. 5 depicts a schematic of a system for reducing the amount of oxygen in packaged food containers.

FIG. 5 depicts a schematic of a system 500 for reducing the amount of oxygen in packaged food containers. The system 500 shown in FIG. 5 is simplified for ease of explanation. Typically, the components of system 500 will be integrated with other components of an automated packaging system, not depicted.

Pneumatic supply 502 is the source of the nitrogen used to flush the package cavity in, for example, the process 1000 outlined above. The pneumatic supply is typically pressurized nitrogen gas stored in a pressurized canister or accumulation tank. In some cases the pneumatic supply 502 is a connection to a pressurized nitrogen supply line shared with other equipment in a packaging facility. The pressure of the nitrogen in the pneumatic supply is typically maintained at 80 to 120 pounds per square inch (psi).

The nitrogen is fed from the pneumatic supply 502 to one or more flow-control units 504. The flow-control units condition the nitrogen flow to deliver the desired output at the exit ports 154 of the lance manifold 150. In some cases, the one or more flow-control units 504 include two pressure regulators and a flow-control valve, all connected in series. The first pressure regulator reduces the line pressure from 120 psi to 65 psi. A second pressure regulator further reduces the line pressure from 65 psi to 45 psi. The flow-control valve may include a rotometer and is used to set the desired nitrogen flow rate.

The flow of nitrogen gas is controlled using one or more control valves 506. If the system is operated with a continuous flow, the one or more control valves 506 may only be used for system interrupt or shutdowns. If the system is operated with a pulsed or intermittent flow, the one or more control valves 506 may be used to control the pulse length and pulse period.

As shown in FIG. 5, the exit ports 154 are pneumatically connected to an oxygen analyzer 508. As shown in FIG. 3, the exit ports 154 may be pneumatically connected using a sensor tube 160, which is physically integrated into the lance manifold 150. The oxygen analyzer 508 may be an oxygen gas analyzer from Bridge Analyzers Inc., Model No. 900601.

The system 500 may also include one or more actuators 512 for inserting the lance manifold 150 into the package cavity. The one or more actuators 512 may include pneumatically actuated cylinders, servo motors, stepper motors, or the like. As described above with respect to process 1000, the lance manifold 150 may be stationary and the package cavity is placed over or formed around the lance manifold 150. The one or more actuators 512 may facilitate the placement of the package cavity. If the system 500 is implemented with VFFS packaging equipment, the one or more actuators 512 may be machinery for controlling the feed of the package film used to form the package cavity.

The oxygen analyzer 508, one or more control valves 506, one or more flow-control units 504, and one or more actuators 512 may be controlled and monitored using a PLC/controller 510 or other computer-controlled automation electronics. The PLC/controller 510 typically includes one or more computer processors, memory for executing computer-executable instructions and input/output circuitry for sending and receiving electronic signals to components in the system. For example, the PLC/controller 510 may include computer-readable instructions for performing one or more operations described above with respect to exemplary process 1000.

4. System Testing and Results

The performance of the manifold lance was compared to two control devices: a tube-in-tube assembly and a welded lance. The tube-in-tube assembly is made from an outer tube, which also serves as the forming tube in a VFFS operation. The outer tube surrounds a second internal tube, which is used to deliver the lettuce product. The nitrogen gas is delivered through an ⅛ inch space between the inside of the outer tube and the outside of the inner tube. As described in the background, the tube-in-tube assembly is disadvantaged over the lance manifold described above with respect to FIGS. 3 and 4. Specifically, the tube-in-tube lance is typically heaver than the lance manifold forming tube assembly, is more difficult to sanitize, and may cost twice as much to manufacture. As shown in FIG. 10 and discussed below, the tube-in-tube does not provide significant performance advantages with regard to reduced product-in-seal (PIS) package failures. The welded control lance has a nitrogen gas input connected to a welded or partially welded flat tube on the inside of the lance. As shown in FIG. 10 and discussed below, the welded control lance delivers the nitrogen gas less efficiently and requires higher volume (SCFH) than manifold lance.

EXAMPLE 1

New Lance Manifold Performs as Well as or Better Than Control Devices

FIG. 10 depicts testing results comparing the lance manifold "new lance" to two control devices described above: tube-in-tube and welded lance. The tests were designed to verify that the performance of the new lance met or exceeded the performance of existing designs. As an indicia of performance, the number of occurrences where lettuce product was caught in the seal jaw were recorded. With regard to FIG. 10, the columns designated "# PIS" represents the recorded number of product-in-seal failures and "% PIS Leaker" represents the percentage of product-in-seal failures that resulted in leaking packages.

The tests were conducted at three different production facilities: Soledad, Bessemer City, and Springfield. All three production facilities were producing the same product, Classic Romaine. All three production facilities operated the manifold lance and control devices at 45 psi of nitrogen while producing 55 bags per minute. The comparison was performed for a target oxygen ($O_2$) content of 4%. Oxygen values were measured using traditional destructive testing techniques.

As shown in FIG. 10, there is some variation in the results due to a number of factors at the different production facilities. For example, the age of the lettuce may affect the water content of the leaves, resulting in different leaf weights. This in turn may affect the product in seal (PIS) failure rate as lighter leaves are more prone to be blown into the sealing jaws of the packaging equipment. Lettuce processed at the Soledad facility is typically 1-2 days old. Lettuce from the Springfield and Bessemer facilities is typically 3-6 days old and has a reduced water content than the lettuce from at Soledad. Therefore the lettuce from the Springfield and Bessemer facilities tends to be lighter, which leads to increased PIS failures. Additionally, variance in packaging machine operator skills and techniques can also affect the results.

As shown in FIG. 10, the lance manifold ("new lance") is able to reproduce oxygen levels that are within an acceptable range and are comparable to the oxygen levels produced using the two control devices. Also shown in FIG. 10, the new lance is able to produce acceptable oxygen concentration levels using a lower flow rate than the welded control lance. For example, for results at the Bessemer City facility, the new lance was able to operate at 360 SCFH, as compared with the welded lance control, which required 480 SCFH.

The new lance compared favorably to both control devices with respect to PIS failure rates (% PIS leaker). In all cases, the new lance had either a better failure rate or had a failure rate that was not statistically distinguishable to the failure rate of both control devices. As shown in FIG. 10, the tube-in-tube assembly does not provide a performance advantage with respect to an improved failure rate to offset the numerous other disadvantages discussed above in the background, including, for example, cost, weight, and ease of sanitation.

EXAMPLE 2

Oxygen Analyzer of the Lance Manifold Compared to Destructive Testing

A lance manifold having an oxygen analyzer was used to package the products shown in the left-hand column of FIG. 11. The oxygen analyzer was a Bridge oxygen gas analyzer, model no. 900601. Destructive testing was performed on the same packages using traditional testing techniques. Specifically, in destructive testing, a hollow syringe needle attached to a Bridge oxygen gas analyzer was inserted into the package to draw an air sample. Because the packages had been punctured, the package and lettuce contents were discarded after testing.

Figure 12:
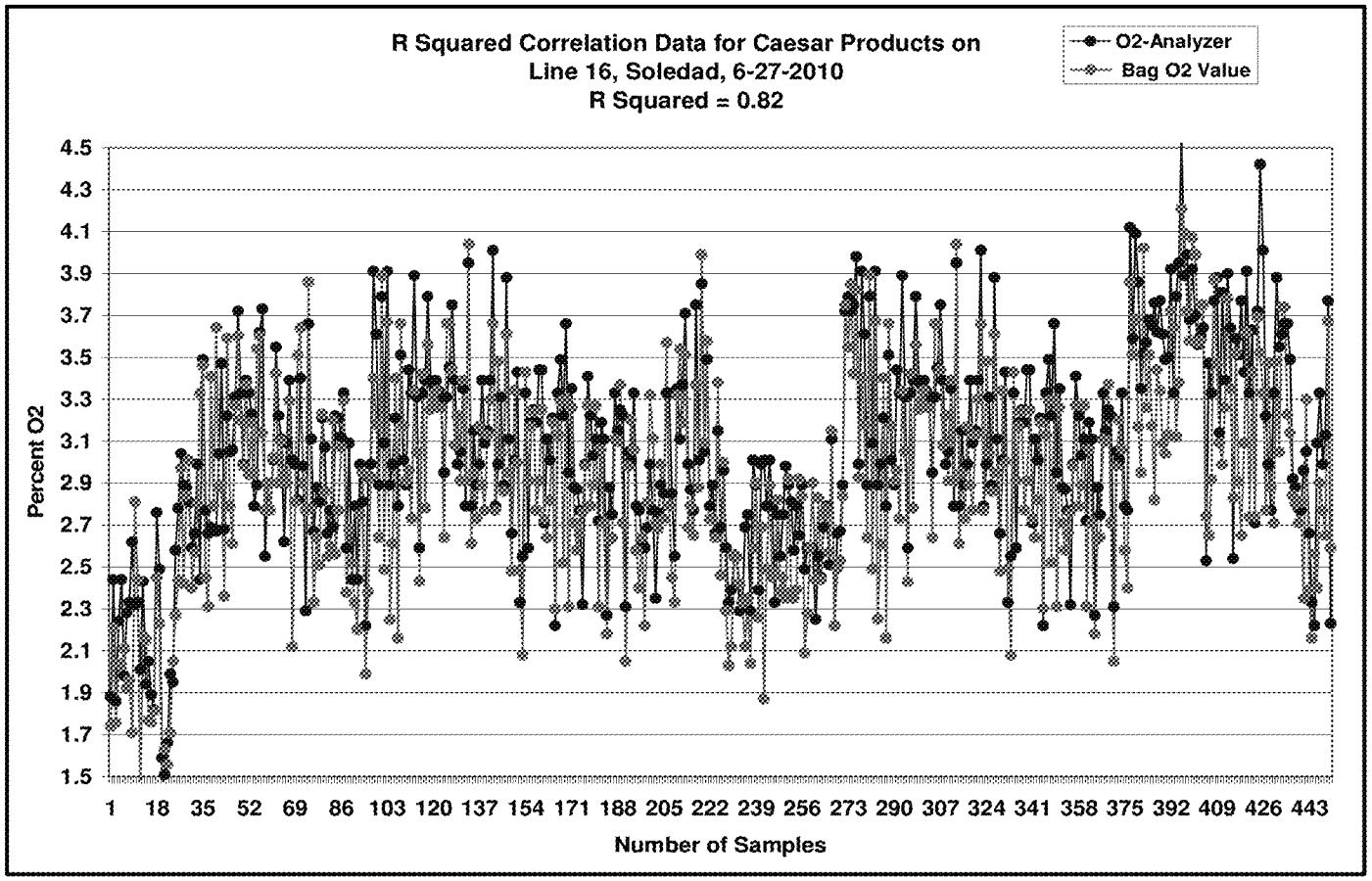
FIGS. 12, 13, and 14 depict measured correlation data between oxygen levels measured using the sensor port compared to oxygen levels measured using destructive testing.
Figure 13:
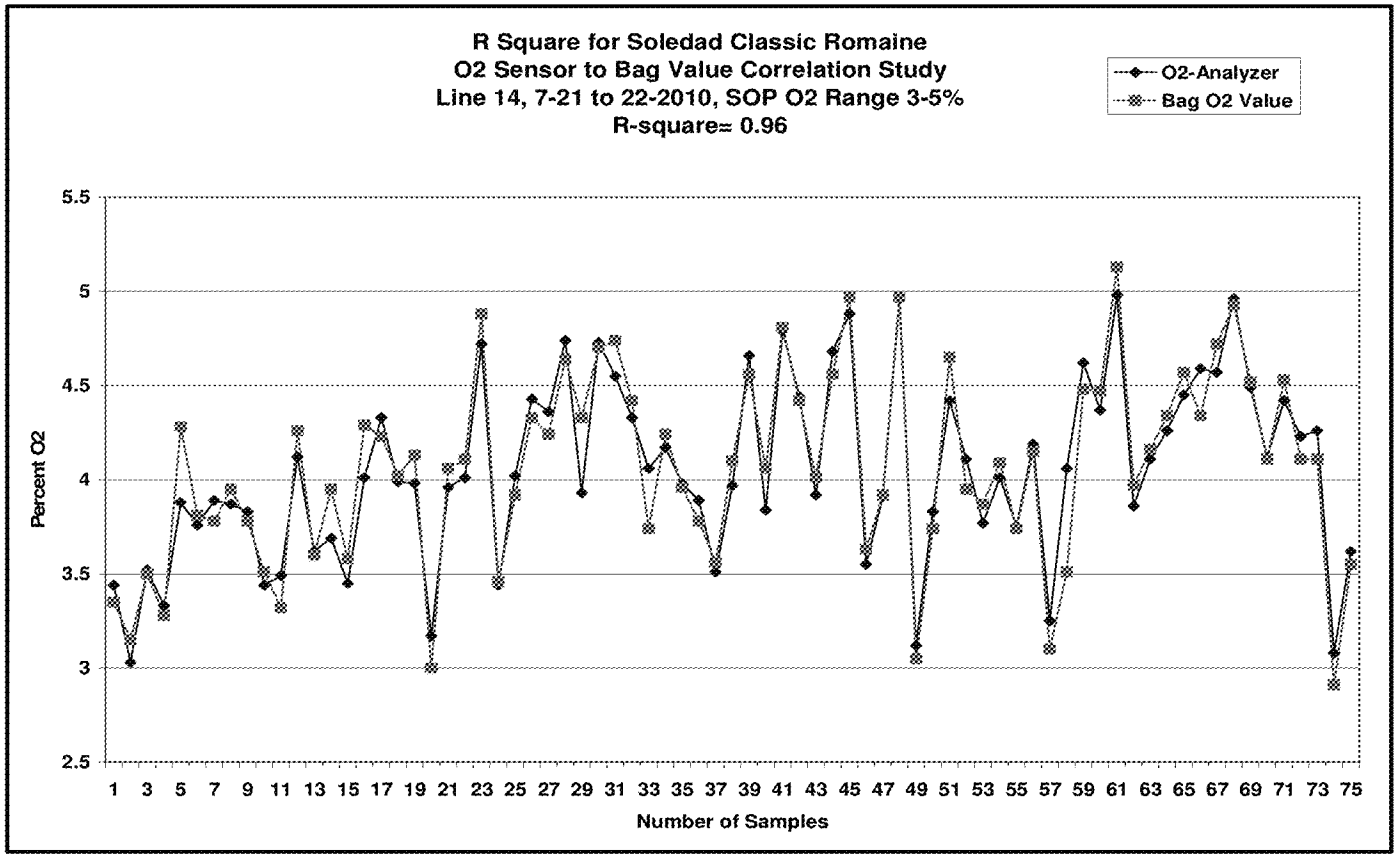
Figure 14:
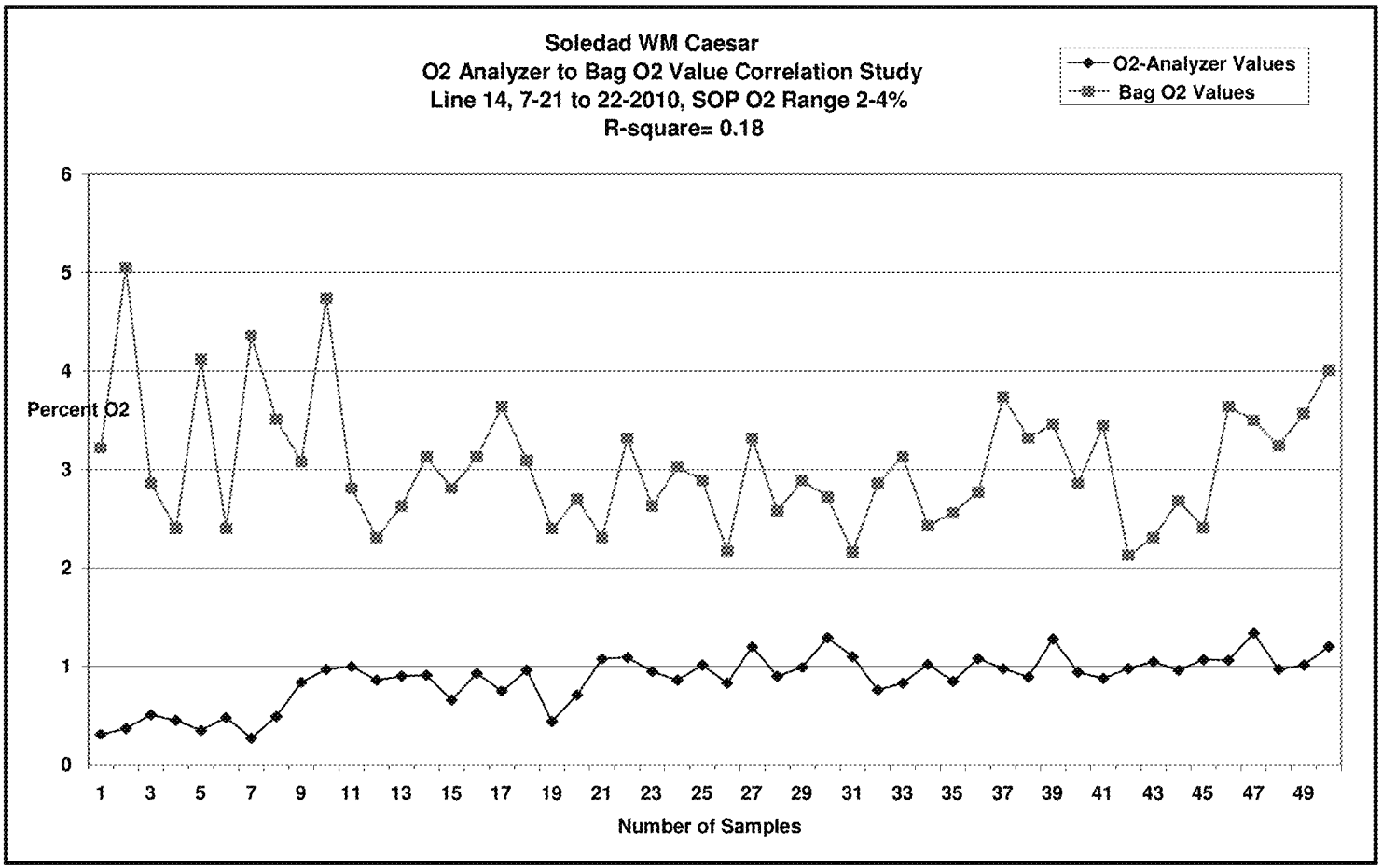

FIG. 11 depicts a comparison between oxygen levels measured using the sensor port on the lance manifold and oxygen levels measured using destructive testing techniques. In general, the results demonstrate an acceptable correlation between the oxygen levels measured using the manifold lance sensor port and traditional (destructive) bag testing techniques. One exception to this general observation is that the results for the WM Caesar product, which is explained in more detail below. FIGS. 12, 13, and 14 depict r-squared correlation data between oxygen levels measured using the sensor port compared to oxygen levels measured using destructive testing.

For the Caesar product, a high correlation value (R-square=0.82) indicates the $O_2$ analyzer was able track the changes found from normal process variation. The Caesar product includes a master pack insert component, which includes additional non-lettuce product (e.g., croutons or non-lettuce vegetables) that is packed with an oxygen content that may higher than the oxygen content of the main package. In some cases, the master pack contains an additional 1-2% of $O_2$ that diffuses into the package contents over time. Therefore, Caesar products require the lowest initial post packaging $O_2$ concentration levels and increased nitrogen flush volumes. See also the graph depicted in FIG. 12.

For the Classic Romaine product, there was a higher correlation value (R-square=0.95). This may be due in part to the lack of a master pack insert as used in the Caesar and WM Caesar products. See also the graph depicted in FIG. 13.

For the WM Caesar product, there was a low correlation (R-square=0.18). The low correlation may be due to the very large master pack insert, which takes up ⅓ of the total volume of the package. See also the graph depicted in FIG. 14.

EXAMPLE 3

Oxygen Analyzer of the Lance Manifold Demonstrates Acceptable Repeatability

Figure 15:
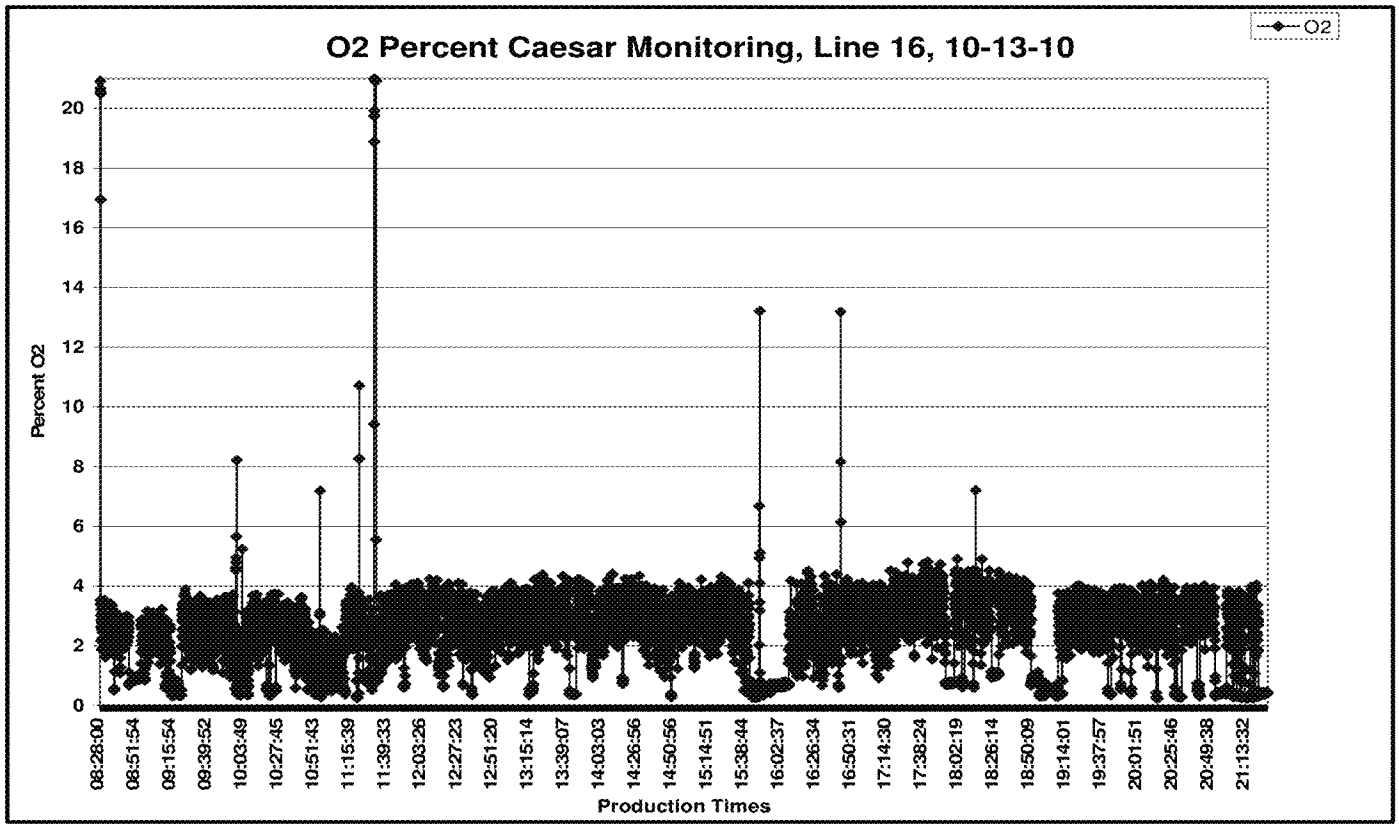
FIG. 15 depicts measured oxygen content of a production line using a manifold lance.

FIG. 15 depicts measured oxygen content of a production line using a manifold lance. FIG. 15 depicts one day's worth of production oxygen data and demonstrates the degree of variability and process capability of the system. Large spikes in the oxygen content represent a stoppage or interruption in the packaging process. By aggregating the time that the system was measured at an oxygen content above a certain threshold, a percentage of system uptime (or downtime) can be estimated.

EXAMPLE 4

Impact of Oxygen Content on Shelf Life of Packaged Romaine Lettuce

FIG. 6 depicts exemplary decay scores over time for packaged Romaine lettuce packaged with different concentrations of oxygen ($O_2$). As shown in FIG. 6, shelf-life may be reduced if the oxygen content is too low. For example, packaged produce with an oxygen content of 1% may decay one to four days faster than packaged produce with an oxygen content of approximately 5%.

For some packaged Romaine lettuce produces, too much oxygen may cause a polyphenoloxidase reaction, which results in pinking of the lettuce leaves. FIG. 7 depicts exemplary decay scores over time for packaged Romaine lettuce packaged with different concentrations of oxygen ($O_2$). As shown in FIG. 7, decreased oxygen levels resulted in reduced pinking scores. Specifically, Romaine lettuce that was packaged with an initial oxygen content of 3% and 1% had reduced pinking scores as compared to packages having an initial oxygen content of 5%.

The foregoing descriptions of specific embodiments have been presented for purposes of illustration and description. They are not intended to be exhaustive or to limit the invention to the precise forms disclosed, and it should be understood that many modifications and variations are possible in light of the above teaching.

We claim:

1. A system for reducing oxygen in a package of produce product, the system comprising:

a partially-enclosed cavity for containing the produce product, the partially-enclosed cavity having a cavity opening;

a lance manifold adapted to be interested into and removed from the partially-enclosed cavity through the cavity opening while the partially-enclosed cavity is stationary, the lance manifold having a first end and a second end, the first end adapted to receive an input gas flow, the second end adapted for placement in the partially-enclosed cavity, the second end comprising:

a plurality of exit ports adapted to produce an output gas flow having:

an approximately oxygen-free composition, a combined flow rate of at least 100 standard cubic feet per hour (SCFH), and a flow direction approximately 90 degrees away from a primary axis of the lance manifold and toward the partially-enclosed cavity, the primary axis of the lance manifold being the axis that is approximately parallel to the direction of the gas flow while it is routed through the lance manifold; and a sampling port; and an oxygen analyzer adapted to detect an oxygen content of gas inside the partially-enclosed cavity using the sampling port, wherein a pressure above atmospheric pressure is maintained within the partially-enclosed cavity, wherein the oxygen content of gas inside the partially-closed cavity is adapted to be maintained after the lance manifold is removed from the partially-enclosed cavity.

2. The system of claim 1, wherein the plurality of exit ports has a combined area of approximately 0.9 square inches.

3. The system of claim 1, wherein the exit ports are further adapted to produce an output gas flow having a maximum velocity of less than 100 feet per second (FPS) as measured at any one of the plurality of exit ports.

4. The system of claim 1, wherein the lance manifold and plurality of exit ports are adapted to deliver the output gas flow at a pressure of less than 45 pounds per square inch (psi), as measured at any one of the plurality of exit ports.

5. The system of claim 1, wherein the plurality of exit ports is configured so that the exit port closes to the second end of the lance manifold is less than 3 inches from the bottom of the partially-enclosed cavity when the lance manifold is inserted.

6. The system of claim 1, further comprising a sensor tube extending from the second end of the lance manifold, wherein the sampling port is disposed near the end of the sensor tube and is at least one inch from the closest exit port of the plurality of exit ports.

7. The system of claim 6, wherein the sensor tube is at an angle of between 5 and 40 degrees from the primary axis of the lance manifold.

8. The system of claim 1, wherein the lance manifold is constructed as a hollow tubular structure, the inside of the hollow tubular structure adapted to route the input gas flow to the plurality of exit ports.

9. The system of claim 8, wherein the hollow tubular structure of the lance manifold has a cross-sectional area greater than 0.2 square inches.

10. The system of claim 8, wherein hollow tubular structure is constructed from a single piece of metal tubing.

11. The system of claim 8, wherein the lance manifold is constructed from less than 6 individual discrete pieces and can be disassembled from a forming tube assembly, the forming tube assembly being adapted to form the partially-enclosed cavity.

12. The system of claim 1, wherein the volume of the portion of the lance manifold adapted for placement into the partially-enclosed cavity is less than 10% of the volume of the partially-enclosed cavity.

13. A lance manifold for flushing a partially-enclosed cavity containing produce product, the partially-enclosed cavity having a cavity opening, the lance manifold adapted to be inserted into and removed from the partially-enclosed cavity through the cavity opening while the partially-enclosed cavity is stationary, the lance manifold comprising:

a first end adapted to receive an input gas flow;

a second end adapted for placement in the partially-enclosed cavity, the second end comprising:

a plurality of exit ports adapted to produce an output gas flow having:

an approximately oxygen-free composition, a combined flow rate of at least 100 standard cubic feet per hour (SCFH), and a flow direction approximately 90 degrees away from a primary axis of the lance manifold and toward the partially-enclosed cavity, the primary axis of the lance manifold being the axis that is approximately parallel to the direction of the gas flow while it is routed through the lance manifold; and a sampling port adapted for use with an oxygen analyzer adapted to detect the oxygen content of gas inside the partially-enclosed cavity, wherein a pressure above atmospheric pressure is maintained within the partially-enclosed cavity, wherein the oxygen content of gas inside the partially-closed cavity is adapted to be maintained after the lance manifold is removed from the partially-enclosed cavity.

14. A method of flushing oxygen from a partially-enclosed cavity for produce product, the method comprising:

introducing a lance manifold into the partially-enclosed cavity through a cavity opening in the partially-enclosed cavity, wherein the lance manifold is adapted to be inserted into and removed from the partially-enclosed cavity through the cavity opening while the partially-enclosed cavity is stationary;

loading the partially-enclosed cavity with produce product through the cavity opening;

flushing the partially-enclosed cavity with a volume of gas using the lance manifold, wherein:

the volume of gas is approximately oxygen-free, a majority of the volume of gas is delivered in a direction that is substantially approximately 90 degrees away from a primary axis of the lance manifold and toward the partially-enclosed cavity, the primary axis of the lance manifold being the axis that is approximately parallel to the direction of the gas flow while it is routed through the lance manifold to the cavity opening of the partially-enclosed cavity, and the volume of gas is delivered at a flow rate of at least 100 standard cubic feet per hour (SCFH);

sampling the gas inside the partially-enclosed cavity using a sensor port on the lance manifold;

determining an oxygen-content measurement based on the sampled gas;

removing the lance manifold from the partially-enclosed cavity; and sealing the partially-enclosed cavity to produce a fully-enclosed package containing the produce product and less than 10% of oxygen by volume of enclosed gas, wherein the oxygen content of the sampled gas inside the partially-closed cavity is adapted to be maintained after the partially-enclosed cavity is sealed to produce the fully-enclosed package;

maintaining a pressure above atmospheric pressure within the partially-enclosed cavity.

15. The method of claim 14, further comprising changing the flow rate of the nitrogen volume of gas delivered to a subsequent partially-enclosed cavity based on the oxygen-content measurement.

16. The method of claim 14, wherein volume of gas is delivered at the maximum exit velocity of less than 100 feet per second (FPS) as measured at an exit port on the lance manifold.

17. The method of claim 14, wherein the volume of gas is delivered at a pressure of less than 45 pounds per square inch (psi).

18. The method of claim 14, wherein the lance manifold is introduced into the partially-enclosed cavity so that the exit port closest to the inserted end of the lance manifold is less than 3 inches from the bottom of the partially-enclosed cavity.

19. The method of claim 14, wherein the method is implemented as part of further comprising: performing a vertical fill-form-seal (VFFS) packaging operation.

20. The method of claim 19, wherein an extended flush is performed after a VFFS packaging operation interruption or operation shutdown, wherein the extended flush includes: flushing the partially-enclosed cavity with a volume of gas for 3 to 5 seconds before restarting the packaging operation.

* * * * *